United States Patent [19]

Van Hemert

[11] Patent Number: 4,989,247

[45] Date of Patent: Jan. 29, 1991

[54] METHOD AND SYSTEM FOR DETERMINING THE VARIATION OF A SPEECH PARAMETER, FOR EXAMPLE THE PITCH, IN A SPEECH SIGNAL

[75] Inventor: Jan P. Van Hemert, Eindhoven, Netherlands

[73] Assignee: U. S. Philips Corporation, New York, N.Y.

[21] Appl. No.: 470,402

[22] Filed: Jan. 25, 1990

Related U.S. Application Data

[63] Continuation of Ser. No. 225,340, Jul. 28, 1988, abandoned.

[30] Foreign Application Priority Data

Jul. 3, 1987 [NL] Netherlands ..... 8701798

[51] Int. Cl.[5] ..... G10L 7/02

[52] U.S. Cl. ..... 381/41; 381/49

[58] Field of Search ..... 381/29-50; 364/513.5

[56] References Cited

U.S. PATENT DOCUMENTS 4,384,335 5/1983 Duifhuis et al. ..... 364/513
4,653,098 3/1987 Nakata et al. ..... 381/49
4,731,846 3/1988 Secrest et al. ..... 381/49
4,791,671 12/1988 Willems ..... 381/49
4,809,334 2/1989 Bhaskar ..... 381/49
4,813,075 3/1989 Ney ..... 381/43

*Primary Examiner*—Dale M. Shaw
*Assistant Examiner*—John A. Merecki
*Attorney, Agent, or Firm*—Bernard Franzblau

[57] ABSTRACT

In a method of and a system for determining the variation of a speech parameter, for example, the pitch, in a speech signal, values ms(i,j) and coupling vectors v(i,j) are calculated for time instants i and a number of values j of the speech parameter $f_j$ for each time instant i by means of an optimization algorithm. Of the values ms(m,j) associated with the last time instant i=m, the optimum (that is to say the smallest or, on the contrary, the largest) value is determined. By use of the coupling vectors, the variation of the speech parameter as a function of time can be obtained by means of a back-tracking procedure. In the calculation of the values ms(i,j), inter alia, a cost parameter k is taken into account which is a measure of the deviation of the speech parameter $f_j(i)$ at the time instant i with respect to a predicted value for the speech parameter at the time instant i.

12 Claims, 2 Drawing Sheets

METHOD AND SYSTEM FOR DETERMINING THE VARIATION OF A SPEECH PARAMETER, FOR EXAMPLE THE PITCH, IN A SPEECH SIGNAL

This is a continuation of application Ser. No. 225,340, filed JULY 28, 1988, now abandoned.

BACKGROUND OF THE INVENTION

This invention relates to a method of determining a speech parameter, for example the pitch, as a function of time in a speech signal, and to a system for carrying out the method.

Hereinafter the invention will be explained in more detail with reference to a method and a system for determining the variation of the pitch as a function of time. It should, however, be stated that the invention is of wider applicability and could also be used to determine, for example, one or more formants of the speech signal as a function of time.

For a number of applications, such as analysis and resynthesis of speech and investigation of intonation contours, the variation of the pitch as a function of time in continuous speech has to be measured. This appears to be a fairly complex problem and there are not any pitch meters which do not make any measuring errors. On the other hand, the speech quality after analysis/resynthesis is to a considerable extent, determined by the correctness of the measured pitch contour. It is therefore of important to have pitch meters which make few measuring errors. For this purpose a method which calculated the pitch in the frequency domain was developed in the past by Duifhuis, Willems and Sluyter. This method, which is known under the name of & harmonic sieve, is known, inter alia, from the published Dutch Patent Application No. 7812151 which corresponds to U.S. Pat. No. 4, 384,335 (5/17/83). In this method (i) in a first step time segments of the speech signal are derived from the speech signal at m time instants which regularly follow each other, and from each time segment $i(1 \leqq 1 \leqq m)$ there is degree a measure of fit $p(i,j)$ which is associated with the time segment and which, for a series of n possible values for the speech parameter, in this case the pitch, indicates how well a chosen value $f_j$ for the speech parameter $(1 \leqq j \leqq n)$ fits the speech signal of the relevant time segment. The variation of the speech parameter in the speech signal as a function of time can then be determined in various ways from the degree of fit.

In view of the results obtained by means of the known method, the method for determining the pitch never-the-less appears still to be in need of improvement.

SUMMARY OF THE INVENTINO

An object of the invention is therefore to provide a method and a system for carrying out the method which yields still better results. For this purpose, the method is further characterized in that (ii) in a second step for the time instant $i=1$ and for each of the n possible values $f_j$ for the speech parameter, a value $ms(1, j)$ associated with said speech parameter, which value is equal to $p(1, j)$, is stored in a memory, (iii) in a third step for a certain time instant $i(>1)$ and a certain possible value $f_j$ for the speech parameter, a number of summation values $s_h(i,j)$ are derived in accordance with the formula $s_h(i,j)=p(i,j)+ms(i-1, h)+k(f_j(i),f_h^*(i))$, where h runs from x up to and including y and for x and y it holds true that $$1 \leqq x \leqq j,\ j \leqq y \leqq n \text{ and } x \neq y.$$

of all the $y-x+1$ summation values $s_h(i,j)$ the optimum summation value is stored in the abovementioned memory as the value $ms(i,j)$ and, in addition, a coupling vector $v(i,j)$ which refers to the value $f_h(i-1)$ of the speech parameter the time instant $i-1$ which, for the relevant index h, resulted, according to the above formula, in the optimum summation value, is stored in a memory, (iv) in that the third step is repeated for all the other indices j at the time instant i, (v) in that the third step is repeated for all the indices j for a subsequent time instant $i+1$, (vi) and in that $k(f_j(i),f_h^*(i))$ is a cost parameter which is a measure of the deviation of the speech parameter $f_j(i)$ at the time instant i with respect to a predicted value $f_h^x(i)$ for the speech parameter at the time instant i, which predicted value is derived from at least the speech parameter value $f_h(i-1)$ at the time instant $i-1$, and is determined in accordance with the formula $$f_h^*(i) = a_o + a_1 f_h(i-1) + \sum_{z=2}^{r} a_z f_1(i-z)$$

where $a_o$ is a constant which is less than zero and, if $r \geqq 2$, $f_j(i-z)$ is the value for the speech parameter at the time instant $i-z$, which value lies on a sub-path which, via the coupling vectors $v(i,j)$, leads to the speech parameter $f_h(i-1)$ at the time instant $i-1$.

The invention is based on the insight that, in the known method, the time segments are treated independently of each other. For each time segment, the value for the bit is a taken for which the measure of pitch is minimum (or to the contrary, maximum), depending on whether the minimization algorithm or a maximization algorithm was used. Because each time segment is treated separately in the known method, the variation of the pitch as a function of time may be discontinuous. Discontinuities in the variation of the pitch are, considered physically, not very problable and must therefore be considered as incorrect measurements.

The pitch in subsequent time segments is strongly correlated and a number of pitch errors could be avoided if these correlations were taken into account.

According to the invention, an overall continuity criterion is introduced for this purpose. Said criterion is in fact reproduced by the abovementioned formula $s_h(i,j)$. In fact, this formula represents an optimization problem for the following criterion $$\min_{f_j(i)} \sum_{i=1}^{m} \{p(i,j) + k(f_j(i), f_h^*(i))\}$$

This relates to finding the contour $f_j(i)$ for which the sum over the entire speech utterance is a minimum. Each summed value consists of two components. One component is the measure of fit $p(i,j)$ and the other component is a cost parameter which is a measure of the transition from the point $(i-1, h)$ to $(i,j)$.

This optimization problem can be solved with the aid of dynamic programming. Starting from this criterion, the formula for $s_h(i,j)$ can be set up making use of the principle of suboptimality, see R. Bellman (1957), Dynamic Programming, University Press, Princeton.

Said principle states that, if a point (i,j) lies on the overall optimum path, then the sub-path from the starting point to the point (i,j) forms part of the overall optimum path.

With the aid of the procedure in the third step, the value ms(i,j) and the predecessor (i−1, h) is determined and stored for every point (i,j). As described above, in the minimization algorithm, the optimum summation value ms(i,j) is therefore the smallest summation value of the y−x+1 summation values. If a maximization algorithm has been used, it should be clear that the optimization value is precisely the largest of the y−x+1 summation values $s_h(i,j)$.

The value of j for which the value ms(m,j) is lowest determines the end point of the optimum path. The optimum path can then be backtracked by means of the & coupling vectors and the variation of the pitch can be determined over the length of the speech signal.

It should be reported that the German Patent Application No. 3,640,355 which corresponds to U.S. Pat. No. 4,813,075 (3/14/89), likewise describes an optimization criterion for determining the variation ofthe pitch in a speech signal.

The calculation of the summation value is, however, carried out in a different manner therein.

In the method according to the invention, inter alia, a predicted value is derived for the pitch. The formula for calculating a predicted value contains at least two terms, viz. the term $a_o$, which is negative and indicates that the variation of the pitch, viewed in time, is primarily falling (declination) and the term $a_1 f_h(i-1)$, which $a_1$ is preferably equal to 1. That is to say, except for the term $a_o$, which indicates the declination, the predicted value $f_h^x(i)$ for the pitch in the time segment i is equal to the pitch $f_h(i-1)$ in the preceding time segment i−1.

In the method described in the German patent application, no predicted value is derived for the pitch. Nor is any account taken therein of the natural declination of the pitch as a function of time. Preferably, the measures of fit p(i,j) are derived in the first step by making use of the harmonic sieve already discussed above. Such a preprocessing of the information before the dynamic programming step is of great advantage because it makes possible a better determination of the variation of the speech parameter as a function of time in the speech signal.

The system for carrying out the method is characterized in that the system is further provided with

- a first unit for deriving time segments from the speech signal at m time instants regularly following each other and for deriving from each time segment the degree of fit p(i,j) associated with a time segment,
- a second unit for deriving the values ms(i,j), a third unit for determining the summation values $s_h(i,j)$ and for determining the optimum summation value ms(i,j) from all the y−x+1 summation values associated with a particular index (i,j), where i≠1,
- a first memory for storing the value ms(i,j) therein,
- a second memory for storing the coupling vectors v(i,j),
- a fourth unit for determining the predicted value $f_{hx}(i)$ for the speech parameter, and
- a fifth unit for determining the cost parameter $k(f_j(i), f_h^x(i))$.

BRIEF DESCRIPTION OF THE DRAWING

The invention will be explained in more detail in the descri.tipon of the accompanying drawing in which.

DESCRIPTION OF THE PREFERRED EMBODIMENTS

First of all the first step of the method will be discussed. In this step, the degree of fit p(i,j) is derived. One way of determining the measure of fit is to make use of the harmonic sieve mentioned previously. In this connection, time segments of the speech signal are derived from the speech signal at m time instants which regularly follow each other and which are, for example, in each case 10 ms apart. Said time segments may, for example, have a length of 40 ms.

The amplitude frequency spectrum is calculated for, sieve is then used to examine whether said peaks form a harmonic structure, that is to say, whether said peaks lie on multiples of a fundamental harmonic $f_j$. For this purpose, the harmonic sieve is tried for a number of values of $f_j$. The sieve has apertures at multiples of said tried value. A measure of fit p(i,j) is calculated on the basis of the number of peaks which pass through the sieve:

$$p(i,j)=W(i)\ \{M(i,j)+I(j)\}/J(i,j)$$

where j is the index of the pitch candidate, j running from 1 up to and including n, i is the number of the time segment, M is the number of the highest harmonic which has passed through the sieve, I is the number of peaks in the spectrum and J is the number of peaks which have passed through the sieve . W(i) is a weighting factor which is zero in the voiceless and quiet passages in the speech and which is not equal to zero in the voiced sections of the speech. Preferably, W(i) increases with an increasing amplitude of the voiced sections.

Note that p(i,j) is high if few peaks pass through & the sieve and low if many peaks pass through the sieve. This criterion is used as a measure of how well (p islow) or badly (p is high) the tried pitch (index j) fits in the time segment (index i).

Figure 1:
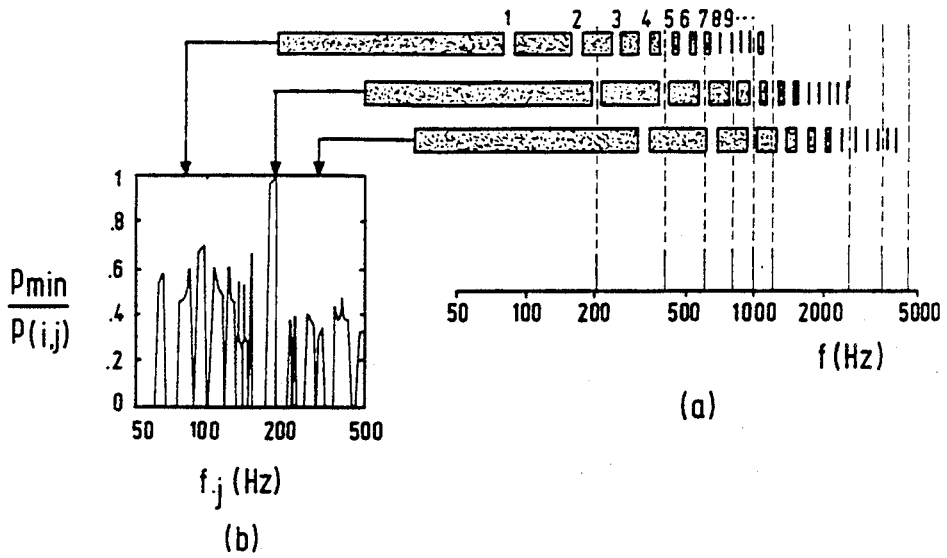
FIG. 1 shows the operation of a harmonic sieve.

FIG. 1 indicates the operation of the harmonic sieve. FIG. 1*a* indicates three positions of the harmonic sieve. A first position for which the fundamental harmonic of the sieve is approximately 80 Hz, a second position for which the fundamental harmonic is 200 Hz and a third position for which the fundamental harmonic is approximately 350 Hz. The time segment contains harmonics at 200 Hz, 400 Hz, 600 Hz, etc., see FIG. 1a. With the harmonic sieve in the second position, all these frequency peaks pass through, the sieve. p(i,j) is therefore lowest for this position of the sieve. In FIG. 1*b*, p(i,j) is plotted as a function of the frequency $f_j$ corresponding to the position of the fundamental harmonic of the sieve. Along the vertical axis in FIG. 1*b*, it is not p(i,j)

itself which is plotted, but pmin/p(i,j), $p_{min}$ being the smallest value of p(i,j) associated with the time segment i. Since p(i,j) was smallest for the sieve in the second position ($f_1$=200 Hz), as a consequence that pmin/p(i,j) becomes equal to 1 for $f_j$=200 Hz, see FIG. 1*b*.

Figure 2:
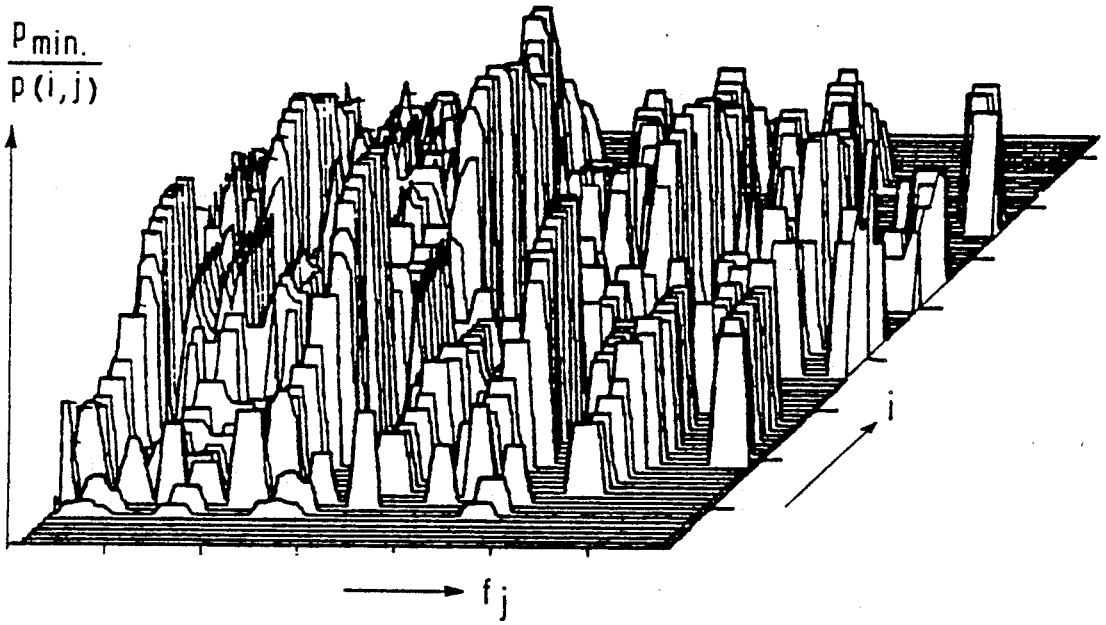
FIG. 2 shows the degree of fit p(i,j)

The values of fit p(i,j) associated with the other time segments i are calculated in a corresponding manner. FIG. 2 shows the measures of fit p(i,j) associated with all the time segments i. In FIG. 2, $p_{min}/p(i,j)$ is plotted as a function of i and $f_j$. In this case, pmin is the smallest measure of fit p(i,j) of all the time segments.

Note that in FIG. 1*b* not only the highest peak in a time segment provides information about the pitch, but that also the other peaks are possible good candidates for the pitch in the time segment concerned. This information about alternative candidates is not discarded but kept. Information from surrounding time segments will be used to choose one candidate from all the candidates for the pitch which fits best into the continuous contour. For this purpose, the measures of fit of all the time instants i and all the sieve positions j are determined.

It is also possible to determine the measures of fit p(i,j) in a manner other than by making use of a harmonic sieve. For example, an autocorrelation function could be determined for each time segment i. In said autocorrelation function, peaks will then be situated at $t_1$ and multiples thereof, $T_1$ being equal to 1 divided by the fundamental harmonic in the time segment. From said peaks it is possible to derive a measure of fit for example, either directly or by means of a "harmonic sieve in time". The said measure of fit is then a function of the index i corresponding to the index j which corresponds to the index $T_j(=1/f_j)$ to again be derived.

Figure 3:
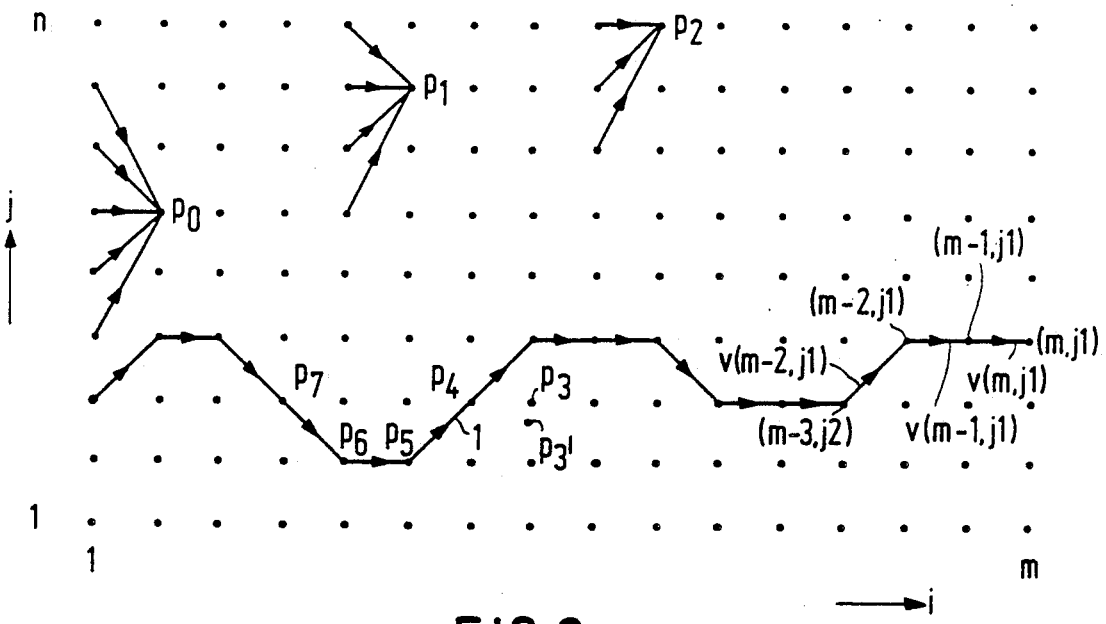
FIG. 3 shows a contour of the pitch as a function of time.

A value ms(i,j) is now derived for all the points i,j in a plane formed by the indices i and j, i and j running from 1 up to and including m and n, respectively (see FIG. 3).

For the points (1, j) this means that ms(1, j) is taken equal to p(1, j), j running from 1 up to and including n. The n values of ms(1, j) are stored in a memory. After this (second) step, a number of summation values $s_h(i,j)$ are calculated with the formula $$s_h(i,j)=p(i,j)+ms(i-1h)+k(f_j(i),\ f_h^x(i)) \quad (1)$$

in a subsequent step for a subsequent time instant (index) i and a particular value $f_j$ (or a particular index j). From FIG. 3, it becomes evident that for an arbitrary point $P_o$ which does not lie too closely along the upper and lower edge of the matrix five summation values are calculated in this case. Each summation value $s_h(i,j)$ is in fact related to a particular transition from the point (i−1, h) to the point (i,j), for which $j-2 \leqq h \leqq j+2$.

If a point (i,j) is closer to the upper or lower edge of the matrix in FIG. 3, that may mean that less than the five (in this example) summation values can be calculated. For the position $P_1$ in FIG. 3, only four summation values can be calculated and for the position $P_2$ only three.

Of the five summation values the smallest value is then taken and stored in the abovementioned memory as the value ms(i,j). In addition, a coupling vector v(i,j) is stored in a (second) memory. Said coupling vector indicates the transition from the point (i−1, h) to the point (i,j) for which the associated summation value $s_h(i,j)$ was smallest. In the (second) memory, v(i,j) can be stored, for example, at a position (i,j) in the form of v(i,j)=h, which means that the point (i,j) is joined to the point (i−1, h).

These calculations are repeated for all the other indices j for one and the same index i.

Figure 5:
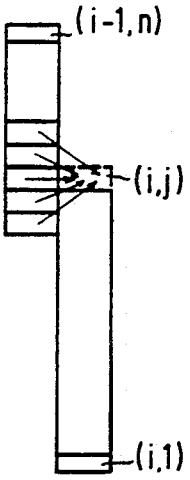
FIG. 5 shows the minimum content (or size) of the first memory.

The calculations are then repeated for all the indices j for a subsequent index i+1. This continues until the calculations have been carried out for all the positions (i,j). The first memory; in which the values ms(i,j) are stored, does not need to be so large that all the values ms(i,j) also remain stored therein. The memory must always be capable of storing the values ms(i,j) associated with the preceding positions (i,j) so that it is possible to calculate a value ms(i,j) for a subsequent position. This means, in the example of FIG. 3, in which a point $P_o$ can be derived from five positions at a preceding time instant, that at least the values ms(i,1) up to and including ms(i,j-1) and the values L ms(i−1,j−2) up to and including ms(i−1,n) then have to be stored (see FIG. 5). If the value ms(i,j) has been calculated, the value ms(i−1,j−2) is no longer necessary and can therefore be discarded. If all the values ms(i,j) have been calculated, only the values ms(m,1) up to and including ms(m,n) are still of importance for the subsequent procedure. The second memory, for the coupling vectors v(i,j), is so large that all the coupling vectors determined can be stored therein. This means that the second memory has to have (m−1)n memory locations. This is because no coupling vectors v(1,j) are determined.

The variation of the pitch during the m time segments can now be determined as follows. The smallest of the numbers ms(m,j) is determined. The index j1 for which ms(m,j1) has the smallest value is the pitch $f_{j1}$ at the time instant m. The predecessor (m−1,j2) is then determined making use of the coupling vector v(m,j1). From FIG. 3, it appears that this precursor is the point (m−1,j1). Subsequently, the coupling vector v(m−1,j1) determining theprecursor (m−2,j1) which precedes the point (m−1,j1). The coupling vector v(m−2,j1) leads to the precursor (m−3,j2). We are able to back-track the contour further with the aid of the coupling vector v(i,j). The precursor of the point (i,j) is, after all, (i−1,v(i,j)).

Proceeding in this manner, the optimum path is back-tracked from the end point (m,j1). In FIG. 3, said optimum path is indicated by the reference number 1. Said optimum path therefore reproduces the variation of the pitch over the total speech signal.

The term $k(f_j(i),f_h^x(i))$ is a cost parameter which will be discussed below. For each point (i,j) a predicted value $f_h^x(i)$ is determined for the pitch in the time segment i making use of the formula:

$$f_h^*(i) = a_o + a_1 f_h(i-1) + \sum_{z=2}^{r} a_z f_1(i-z) \quad (2)$$

$a_o$ is a constant which is less than zero. Said constant takes account of the fact that the variation of the pitch, viewed in time, is predominantly falling (declination). Furthermore $a_1 \neq 0$. Preferably, $a_1 \neq 1$. If all the coefficients $a_z$ are equal to zero, the predicted value $f_h^x(i)$ for the pitch is only determined by the pitch $f_h$ at the time instant i−1: or $$fx(i)=a_o+a_1 f_h(i-1) \quad (3)$$

If a number of coefficients $a_z$ are not equal to zero, $f_f(i-z)$ is the value for the pitch at the time instant i−z which lies on a sub-path which leads via the coupling vectors v(i,j) of the pitch $f_1(i-z)$ at the time instant $i-z$ to the pitch $f_h(i-1)$ at the time instant $i-1$.

An example (see FIG. 3 in this connection):

Suppose the predicted value $f_h^x(i)$ has to be determined for the point $P_3$, starting from the contour which leads to the point $P_4$ having co-ordinates $(i-1, h)$. $f_1(i-2)$ is then the pitch which is associated with the points $P_5$ which is the precursor of the point $P_4$. $f_1(i-3)$ is then the pitch which is associated with the point $P_6$, which is the precursor of $P_5$. The predicted value is now, for example, the point $P_3$. The cost parameter $k(f_j(i), f_h^x(i))$ may be determined, for example, by means of the following formula:

$$k(f_j(i), f_h^x(i)) = b(f_j(i) - f_h^x(i))^2 \quad (4)$$

This means that the value of the cost factor is the more, the larger the value $f_j(i)$ differs from predicted value $f_h^x(i)$.

It should be stated here that the abovementioned first, second and third steps in the method do not necessarily have to be carried out one after the other. It is quite possible that tasks of the method from the first step are carried out, viewed in time, in parallel with tasks of the method from the third step.

As soon as the measures of fit p(i,j) have been determined, for example, in the first step for a particular time segment i, the summation values $s_h(i,j)$ can then be determined in parallel with the determination of the measures of fit p(i+1,j).

Figure 4:
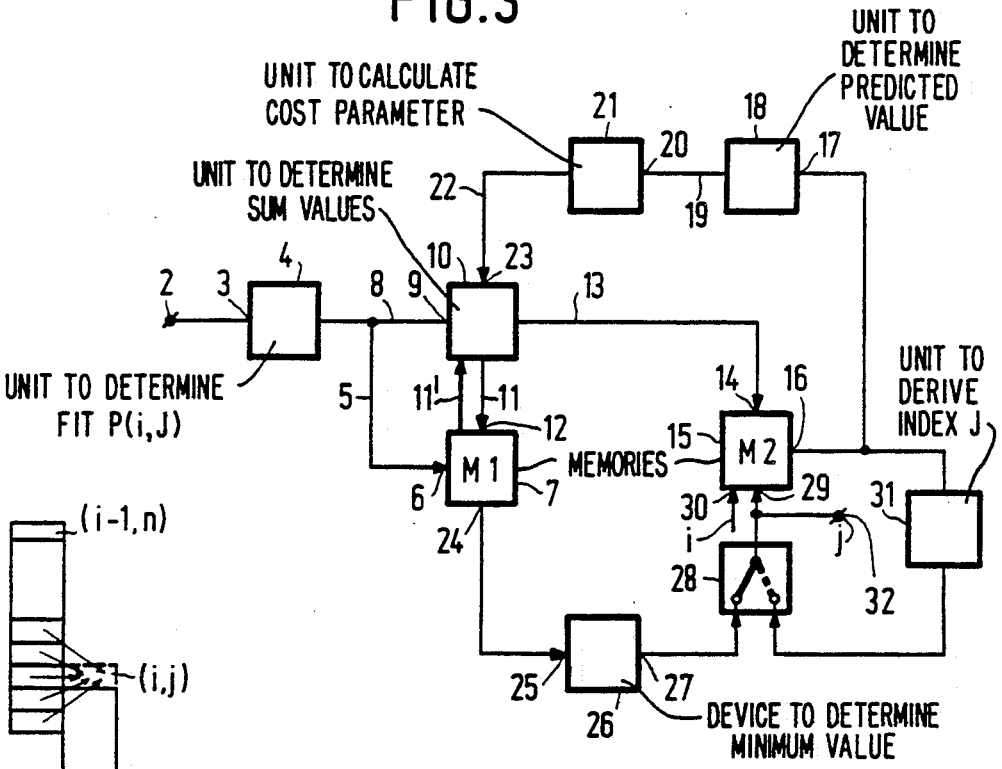
FIG. 4 shows a system for carrying out the method.

FIG. 4 shows diagrammatically a system for carrying out the method. The system contains an input terminal 2, for receiving an electrical speech signal, which is coupled to an input 3 of a first unit 4 in which the values of fit p(i,j) are determined. The values of fit p(1, j) are fed via the conductor 5 to an input 6 of a first memory 7 and are stored therein as the values ms(1, j). All the measures of fit p(i,j) are, in addition, fed via the conductor 8 to an input 9 of a third unit 10 which is equipped to determine the summation values $s_h(i,j)$ and to determine the values ms(i,j) for which $i \leqq 2$. These values are fed via the conductor 11 to a second input 12 of the first memory 7. In addition, the memory 7 supplies, via a conductor 11', the values ms(i−1,j)to the unit 10 for the determination of the values $s_h(i,j)$ in accordance with formula (1).

The third unit 10 is further equipped to determine the coupling vectors v(i,j) for which $i \geqq 2$. The information relating to the coupling vectors is fed, via the conductor 13, to an input 14 of a second memory 15 in which said information is stored.

An output 16 of the second memory 15 is coupled to an input 17 of a fourth unit 18. Said fourth unit is equipped to determine the predicted value $f_h^x(i)$ in accordance with formula (2). If the predicted value $f_h^x(i)$ is determined in accordance with the simplified formula (3), this connection of the second memory to the fourth unit 18 is not necessary since no coupling vectors are needed to determine $f_h^x(i)$. The predicted value $f_h^x(i)$ is fed, via the conductor 19, to the input 20 of the fifth until 21. Said fifth unit 21 calculates the value of the cost parameter $k(fj(i), f_h^x(i))$ in accordance with formula (4). This value is fed, via the conductor 22, to a second input 23 of the third unit 10 and is used in said third unit 10 in calculating the summation values $s_h(i,j)$.

An output 24 of the first memory 7 is coupled to an input 25 of a minimum value determining device 26. After all the values ms(i,j) have been determined, the values ms(m,.1) are always still stored in the memory 7. The values ms(m,j) are fed to the minimum value determining device 26. The latter determines the smallest value of the n values ms(m,j). The index j1 associated with this lowest value is presented to the output 27 and fed to the address input 29 of the second memory 15 via a switch unit 28. The index i=m is presented to a second address input 30. This means that the second memory 15 emits the coupling vector v(m,j1) at the output 16. This coupling vector is fed to a sixth unit 31 which derives the index j=j1 for the time instant m−1 from said coupling vector v(m,j1). With the switch unit 28 in the other position, said index is now presented to the address input 29 and the index i=m−1 is presented via the address input 30. The second memory 15 now emits the coupling vector v(m−1,j1) at the output 16. The sixth unit 31 then delivers the index j=j1 to the address input 29. The index i=m−2 is therefore presented to the address input 30. The memory 15 then delivers the coupling vector v(m−2,j1) to the sixth unit 31. The second memory 15 then delivers the coupling vector v(m−3,j2) under the influence of the indices i=m−3,j=j2. This continues until the index i=1 is reached. A series of indices j which is a measure, in reversed time sequence, for the variation of the speech parameter (pitch) as a function of time is presented at the output 32.

FIG. 4 indicates only the most necessary elements and connections. For the entity to function satisfactorily, a control unit (not shown) which sends various control signals and addressing signals to the various units should, of course, be present. Nowhere near all of these control signals and addressing signals are indicated in FIG. 4. It should be clear to the person skilled in the art that, where control and addressing signals are needed, these are also generated by the control unit and fed to the relevant unit. Thus, it is, for example, clear that the third unit needs ten addressing signals in the form of the indices i,j and h to determine the summation values $s_h(i,j)$ in accordance with the formula (1).

It should be stated that the invention is not limited solely to the exemplary embodiment shown. The invention is equally applicable to those methods or systems which deviate from the method or system described in points not relating to the invention.

Thus, it is, for example, possible to determine the measure of fit in the first step of the method in ways other than that described. In this connection, the use of an AMDF (average magnitude difference function) method also comes to mind. Furthermore, a minimization procedure has been described above. It is also possible, on the other hand, to use a maximization procedure.

What is claimed is:

1. A method for determining the variation of a speech parameter of a speech signal as a function of time comprising:

(i) in a first step deriving time segments of the speech signal at a number of time instants m which regularly follow each other, and from each time segment $i(1 \leqq i \leqq m)$ deriving a degree of fit p(i,j) associated with the time segment and which, for a series of n possible values for the speech parameter, indicates how well a chosen value $f_j$ for the speech parameter $(1 \leqq j \leqq n)$ fits the speech signal of the time segment i, (ii) in a second step for the time instant $i=1$ and for each of the n possible values $f_j$ for the speech parameter, storing in a memory a value ms(1, j) associated with said speech parameter, which value is equal to p(1,j), (iii) in a third stp for a certain time instant $i(>1)$ and a certain possible value $f_j$ for the speech parameter, deriving a number of summation values $s_h(i,j)$ in accordance with the formula $s_h(i,j)=p(i,j)+ms(i-1, h)+k(f_j(i),f_h^x(i))$ where h runs from x up to and including y and for x and y $1 \leqq x \leqq j$, $j \leqq y \leqq n$ and $x \neq y$, and of all the $y-x+1$ summation values $s_h(i,j)$ an optimum summation value is stored in said memory as the value ms(i,j) and, in addition, a coupling vector v(i,j) which refers to the value $f_h(i-1)$ of the speech parameter at the time instant $i-1$, which, for the relevant index h, resulted, according to the above formula, in the optimum summation value, is stored in a memory, (iv) repeating the third step for all of the other indices j at the time instant i, (v) repeating the third step for all of the indices j at a subsequent time instant $i+1$, (vi) and wherein $k(f_j(i),f_h^x(i))$ is a cost parameter which is a measure of the deviation of the speech parameter $f_j(i)$ at the time instant i with respect to a predicted value $f_h^x(i)$ for the speech parameter at the time instant i, which predicted value is derived from at least the speech parameter value $f_h(i-1)$ at the time instant $i-1$, and is determined in accordance with the formula $$f_h^*(i) = a_o + a_1 f_h(i-1) + \sum_{z=2}^{r} a_z f_1(i-z)$$

where $a_o$, $a_1$ and $a_z$ are constants with $a_o$ being less than zero and, if $r \geqq 2$, $f_1(i-z)$ is the value for the speech parameter at the time instant $i-z$, which value lies on a sub-path which, via the coupling vectors v(i,j), leads to the speech parameter $f_h(i-1)$ at the time instant $i-1$, and $a_1 \neq 0$.

2. A method according to claim 1, wherein $f_h^x(i)$ is determined in accordance with the formula $f_h^x(i)=a_o+a_1.f_h(i-1)$.

3. A method according to claim 1 or 2, characterized inthat the cost parameter $k(f_j(i), f_h^x(i))$ is determined in accordance with the formula $k(f_j(i), f_h^x(i))=b(f_j(i)-f_h^x(i))^2$ where b is a constant other than zero.

4. A method according to claim 3 wherein the speech parameter is the pitch.

5. A method according to claim 3, wherein a fourth step comprises, determining an optimum value ms(m,jl) from the n values ms(m,j), reading out of the memory a coupling vector v(m,j1) associated with the optimum value ms(m,j1), reading out the coupling vector v(i−1, v(i,j)) associated with the time segment $i-1$, and with the value $v(i,j)=h$ of the speech parameter to which the coupling vector v(i,j) associated with the time segment i points, i running from $m-1$ down to and including 1, and reading out the series of subsequent values obtained in this manner for the speech parameter, or optionally storing said subsequent values.

6. A method according to claims 1 or 2, wherein, in the first step, the degree of fit p(i,j) is derived by making use of a harmonic sieve.

7. A method according to claims 1 or 2 wherein the speech parameter is the pitch.

8. A method according to claims 1 or 2, wherein a fourth step comprises, determining an optimum value ms(m,j1) from the n values ms(m,j), reading out of the memory a coupling vector v(m,j1) associated with the optimum value ms(m,j1), reading out the coupling vector v(i−1, v(i,j)) associated with the time segment $i-1$, and with the value $v(i,j)=h$ of the speech parameter to which the coupling vector v(i,j) associated with the time segment i points, i running from $m-1$ down to and including 1, an reading out the series of subsequent values obtained in this manner for the speech parameter, or optionally storing said subsequent values.

9. A system for determining the variation of a speech parameter of a speech signal as a function of time comprising:

an input terminal for receiving the speech signal, - a first unit for deriving time segments from the speech signal at m time instants regularly following each other and for deriving from each time segment $i(1 \leqq i \leqq m)$ a degree of fit p(i,j) associated with a time segment, and which, for a series of n possible values for the speech parameter, indicates how well a chosen value $f_j$ for the speech parameter $(1 \leqq j \leqq n)$ fits the speech signal of the time segment i, a second unit for deriving values ms (i,j) associated with the speech parameter, where for the time instant $i=1$ and for each of the n possible values $f_j$ the value ms (1, j) is equal to p(1, j), a third unit coupled to said first unit for determining summation values $s_h(i,j)$ and for determining an optimum summation value ms(i,j), for all $y-x+1$ summation values associated with a particular index (i,j), where i-1, where h runs from x up to and including y and for x and y $1 \leqq x \leqq j$, $j \leqq y \leqq n$ and $x \neq y$, a first memory for storing the value ms(i,j) therien, means for determining coupling vectors v(i,j), a coupling vector referring to a value $f_h(i-1)$ of the speech parameter at a time instant $i-1$, which for the relevant index h, resulted in an otpimum summation value, a second memory for storing the coupling vectors v(i,j), a fourth unit for determining a predicted value $f_h^x(i)$ for the speech parameter at a time instant i, a fifth unit for determining a cost parameter $k(f_j(i), f_h^x(i))$, and means for determining an optimum value ms(m,jl) from the n values ms(m,j) and reading out the coupling vector v(m,jl) associated with the optimum value ms(m,jl), and for reading out coupling vectors v(i−1, v(i,j)) associated with the time segment $i-1$, and with the value $v(i,j)=h$ of the speech parameter to which the coupling vector v(i,j) associated with the time segment i points, i running from $m-1$ down to and including 1, a series of subsequent values obtained for the speech parameter indicating the variation of the speech parameter as a function of time.

10. A system according to claim 9 wherein the first unit contains a harmonic sieve.

11. A system for determining the variation of a speech parameter of a speech signal as a function of time comprising:

an input terminal for receiving the speech signal, a first unit coupled to said input terminal for deriving time segments i from the speech signal at m time instants regularly following each other and for deriving from each time segment a degree of fit p(i,j) associated with a time segment, where ($1 \leqq i \leqq m$), j is an index indicating values of a speech parameter, $f_j$, where ($1 \leqq j \leqq n$), and there are n possible speech parameter values, a second unit for deriving values ms(i,j) for which $i \geqq 2$, a third unit coupled to said first unit for deriving coupling vectors v(i,j) for which $i \geqq 2$, for determining summation alues $s_h(i,j)$ and for determining an optimum summation value ms(i,j), for all $y-x+1$ summation values associated with a particular index (i,j), where $i \neq 1$, h runs from x up to and including y and for x and y $1 \leqq x \leqq j$, $j \leqq y \leqq n$ and $x \neq y$, a first memory device coupled to said first and second units for storing the values ms(i,j), a second memory device coupled to said third unit for storing the coupling vectors v(i,j), a fourth unit coupled to said second memory device for determining a predicted value $f_h^x(i)$ for the speech parameter, a fifth unit coupled to said fourth unit for determining a cost parameter $k(f_j(i), f_h^x(i))$, and means for determining an optimum value ms(m,jl) from the n values ms(m,j) and reading out the coupling vector v(m,jl) associated with the optimum value ms(m,jl), and for reading out coupling vectors v(i−1, v(i,j)) associated with the time segment i−1, and with the value v(i,j)=h of the speech parameter to which the coupling vector v(i,j) associated with the time segment i points, i running from m−1 down to and including 1, a series of subsequent values obtained for the speech parameter indicating the variation of the speech parameter as a function of time.

12. A system as claimed in claim 11 wherein the cost parameter determined in said fifth unit is fed to said third unit which uses said parameter in determining the summation values $s_h(i,j)$.

* * * * *